United States Patent [19]

Richter, Sr.

[11] 4,270,035

[45] May 26, 1981

[54] SNAP ON MOUNTING CLIP FOR CIRCUIT BREAKERS

[75] Inventor: Konrad J. Richter, Sr., Lawrenceville, N.J.

[73] Assignee: Heinemann Electric Company, Trenton, N.J.

[21] Appl. No.: 57,709

[22] Filed: Jul. 16, 1979

[51] Int. Cl.[3] ..... H01H 13/06

[52] U.S. Cl. ..... 200/294; 335/202; 411/352; 411/522

[58] Field of Search ..... 200/294, 296, 297, 303; 335/202; 339/208; 174/92; 220/4 B, 4 E, 80; 151/41.75

[56] References Cited

U.S. PATENT DOCUMENTS

| | | | |
|---|---|---|---|
| 1,620,693 | 3/1927 | Royal | 174/92 |
| 2,330,372 | 9/1943 | Mittendorf | 151/41.75 |
| 2,401,202 | 5/1946 | Tinnerman | 151/41.75 |
| 2,627,385 | 2/1953 | Tinnerman | 151/41.75 |
| 3,177,331 | 4/1965 | Kawabata et al. | 200/303 |
| 4,087,772 | 5/1978 | Grenier | 200/303 |
| 4,169,966 | 10/1979 | Casati | 174/92 |

*Primary Examiner*—John W. Shepperd
*Attorney, Agent, or Firm*—Joseph G. Denny, III; Peter J. Patane

[57] ABSTRACT

A circuit breaker comprising a molded case formed by two half-cases abutting each other. A snap on mounting clip embraces the half-cases. The clip comprises a central portion and arms on either side thereof embracing the half-cases. The arms include locking protrusions which are received in holes formed in the half-cases. The protrusions are deformed toward the embraced half-case. The arms include end portions flared outwardly of the case. The arms are angled to permit the arms to spring freely as they are pushed over the half-cases. The case includes an upper wall, and the central portion is bowed downwardly so as to be concave relative to said upper wall of said case. The upper wall includes an opening and the central portion of the clip includes a thread receiving opening. The openings in the wall and in the clip are aligned to receive the shank of a threaded fastener for mounting the circuit breaker to a panel.

14 Claims, 11 Drawing Figures

FIG. 1
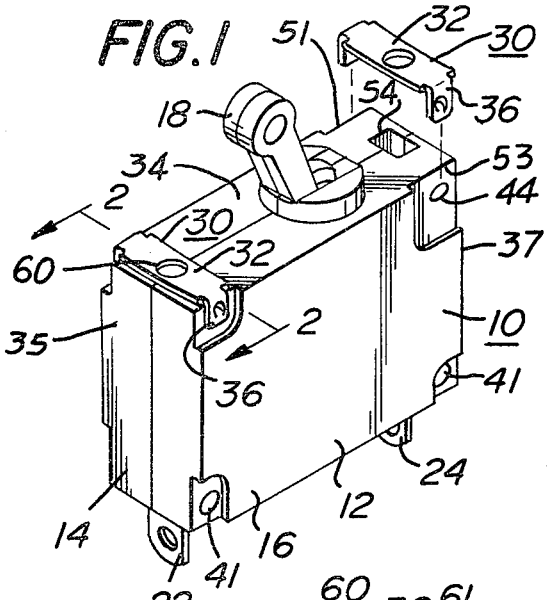
FIG. 3
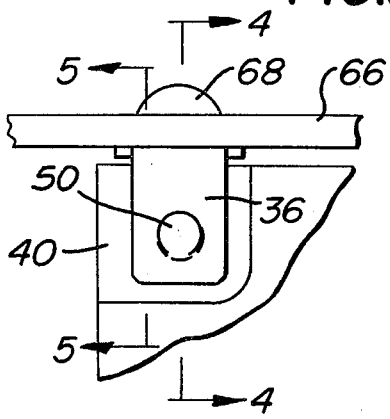
FIG. 2
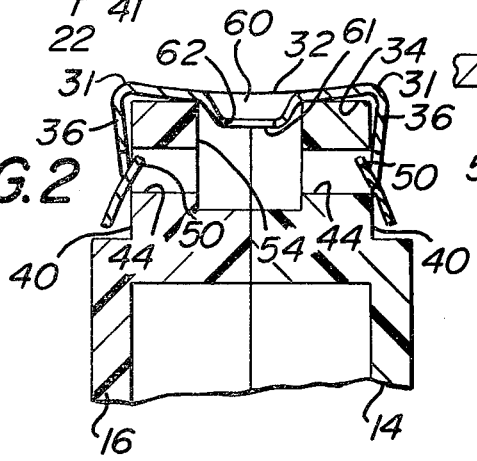
FIG. 4
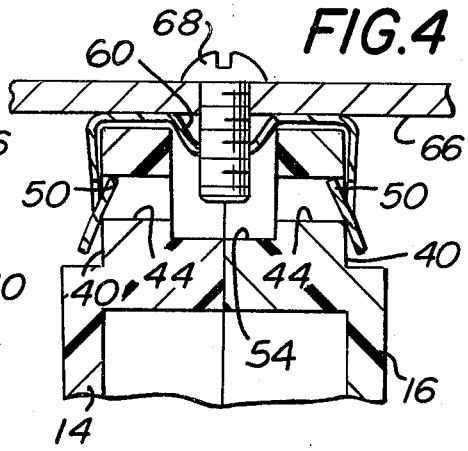
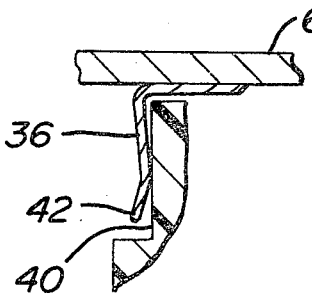
FIG. 5
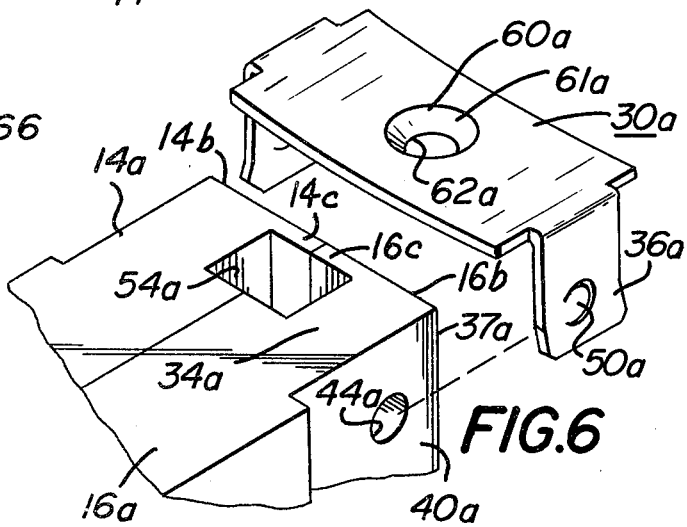
FIG. 6

FIG. 10
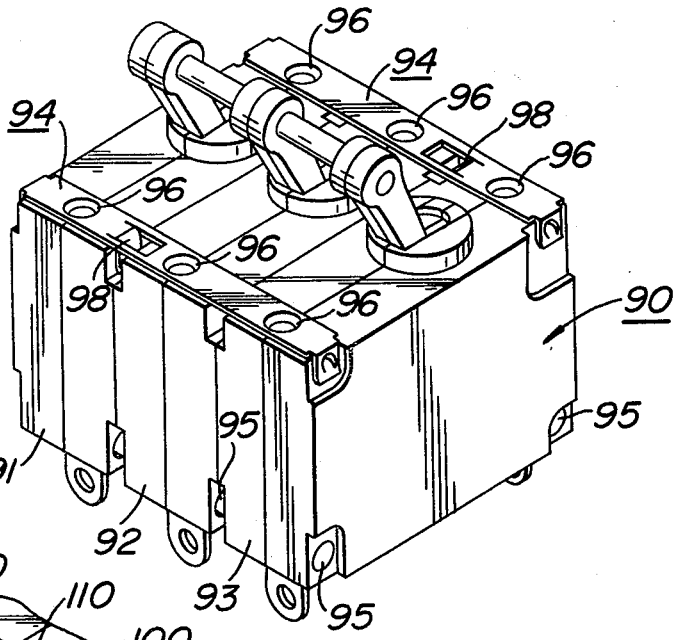
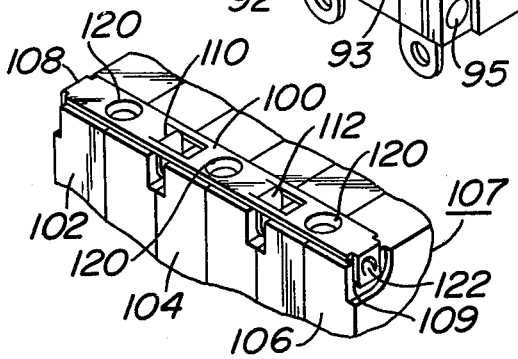
FIG. 11
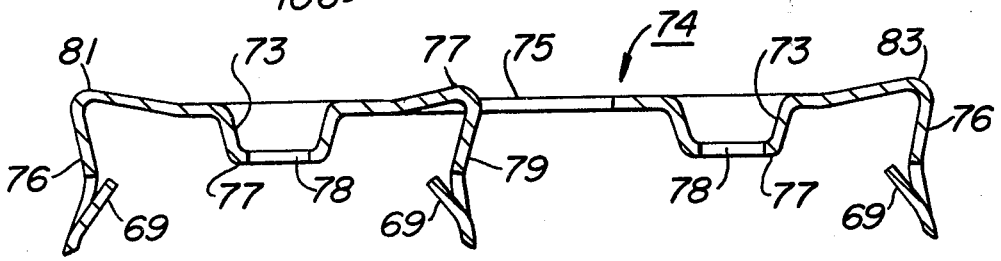
FIG. 9

SNAP ON MOUNTING CLIP FOR CIRCUIT BREAKERS

BACKGROUND OF THE INVENTION

This invention relates generally to molded case electric circuit breakers of the type wherein the case is formed by two half-cases abutted together to jointly form the case. This invention provides a simplified snap on mounting clip or fastener and case combination to secure the half-cases together and simultaneously provide a mounting means to secure the circuit breaker to a panel.

The snap on mounting clip of this invention may be used to replace the insert rivet 24 shown in U.S. Pat. No. 3,329,793.

A mounting clip is shown and described in U.S. Pat. No. 4,087,772. This invention provides a mounting clip which is greatly simplified relative to that of U.S. Pat. No. 4,087,772.

BRIEF SUMMARY OF THE INVENTION

It is an object of this invention to provide a known molded case circuit breaker with a more economical snap on mounting clip or fastener for securing the half-cases together and simultaneously providing a mounting means to secure the circuit breaker to a panel.

The snap on mounting clip includes arms which embrace the half-cases of the case forming a typical molded case circuit breaker. Each arm has a locking tab projecting into a hole or recess formed in the half-cases.

The clip has a central bowed portion which receives a threaded stud to secure the circuit breaker to a panel. When the stud is threaded into the clip, the bowed portion is drawn towards the panel, but in so doing the locking tabs engage the walls defining the holes limiting such upward movement and more positively locking the tabs to the half-cases.

Since the arms have lower portions that are flared outwardly and the tabs are bent from the arms, the clip may be easily assembled to the case by merely sliding it into position in one direct motion without any twisting or cocking of the clip being needed.

The clip provided by this invention is of simplified form and is more economically manufactured and assembled to the case relative to the previously used fastener which provided for tying together the half-cases of the circuit breaker and also provided threads for the panel mounting stud.

The foregoing and other objects of the invention, the principles of the invention, and the best modes contemplated for applying such principles will more fully appear from the following description and accompanying drawings in illustration thereof.

BRIEF DESCRIPTION OF THE VIEWS

In the drawings:

FIG. 1 is a side and top perspective view of a molded case circuit breaker incorporating the present invention, one of the snap on mounting clips being shown spaced from the circuit breaker case;

FIG. 2 is a partial cross-sectional view taken along the line 2—2 in FIG. 1;

FIG. 3 is a partial side view of the circuit breaker shown in FIG. 1 but after it is assembled to a panel;

Figure 7:
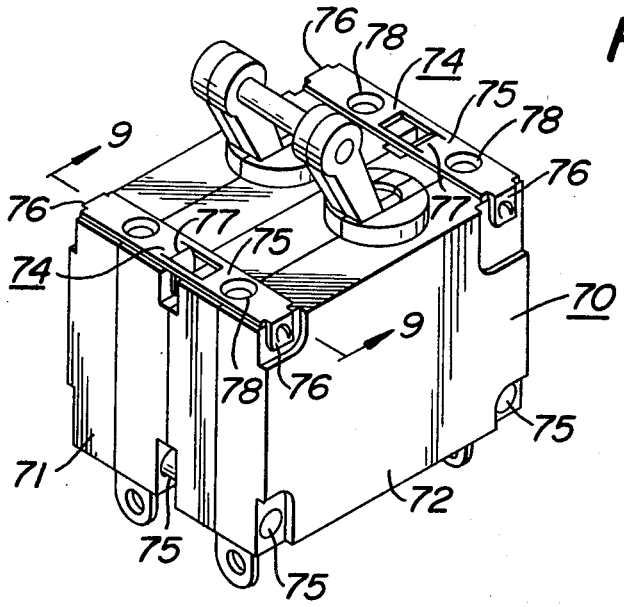
Figure 8:
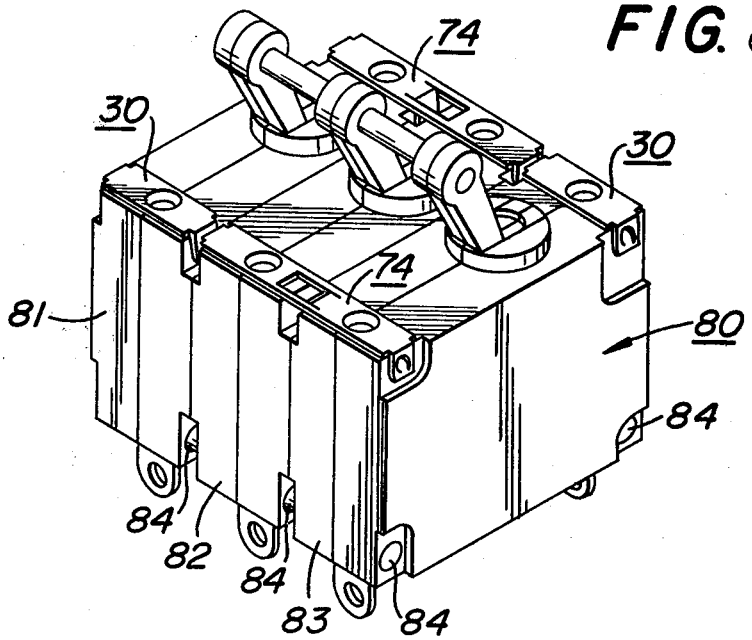

FIGS. 4 and 5 are cross-sectional views taken along the lines 4—4 and 5—5, respective, in FIG. 3;

FIG. 6 is a partial perspective view of the corner portion of a circuit breaker similar to the circuit breaker shown in FIG. 1, but showing a modification of this invention;

FIG. 7 is a side and top perspective view similar to FIG. 1 but showing a modification of this invention adapted for use with a two pole circuit breaker;

FIG. 8 is a side and top perspective view similar to FIGS. 1 and 7, but showing how the fasteners illustrated in FIGS. 1 to 7 may be used to secure together three poles;

FIG. 9 is a cross-sectional view of the fastener only taken along the line 9—9 in FIG. 7;

FIG. 10 is a side and top perspective view similar to FIG. 1, 7, and 8, but showing a further embodiment of this invention for securing together three poles; and FIG. 11 is a partial perspective similar to FIG. 10, but showing a further embodiment.

DESCRIPTION OF THE PREFERRED EMBODIMENTS

Referring to the drawings, a circuit breaker 10 including a case 12 is illustrated in FIG. 1. The circuit breaker 10 is molded from a suitable electrical insulation material, as is well known, and the case 12 comprises two substantially half-cases 14 and 16 which abut each other, as shown, to house the internal parts of the circuit breaker. The half-cases 14 and 16 define a suitable opening through which extends the handle 18 of the circuit breaker 10. Suitable terminals 22 and 24 extend from the case 12 to connect the circuit breaker to a suitable circuit.

The half-cases 14 and 16 are secured together by two snap on mounting clips or fasteners 30 made of spring material, preferably a hardened spring steel, which embrace the upper, opposite corner portions of the case 12, i.e., the portions adjacent the junctures of the top walls 34 and the end walls 35 and 37 of the case 12. The half-cases 14 and 16 are also secured together by two rivets 41 which extend through suitable holes at the lower, opposite corner portions.

Each clip 30 comprises a central, concave portion 32, i.e., bowed downwardly toward the top wall 34 of the case 12, as shown in FIG. 2, so as to form two shoulders 31 at opposite ends. Further, each clip 30 includes two arms 36 one at each end portion of the clip. The arms 36 depend, as shown, and are spring biased toward each other and against the side surfaces 40 of the half-cases 14 and 16.

Each arm 36 is bowed away from the adjacent surface 40, as shown, so that substantially a line contact takes place between the arms 36 and the surface 40, as shown in FIG. 5, while defining lowermost portions 42 that are flared away from the adjacent surfaces 40, so that the arms 36 may be easily pushed down over the half-cases 14 and 16 during assembly.

Referring to FIG. 2, the half-cases 14 and 16 are also formed with horizontal holes or recesses 44, as shown. The holes 44 receive locking tabs or protrusions 50 which are formed on the arms 36, as shown. The locking tabs 50 are bent inwardly toward each other and toward the adjacent half-case. The generally vertically extending locking tabs 50 are connected to the arms 36 at the bottoms of the tabs (as shown) and are bent inwardly about a generally horizontal axis (FIGS. 2 and 4) so that the tabs 50 are inclined toward the adjacent half-case. This inclination of the tabs 50 results in the tabs 50 engaging the upper corner portions 51 and 53 of the half-cases 14 and 16 as the clips are pushed down over the half-cases, but the tabs 50 are flexible enough to bend back at such time, permitting the clip to be moved down to the position shown in FIG. 2, and then spring into the positions shown in FIG. 2.

As illustrated in FIG. 3, the locking tabs 50 are generally circular and mate with the walls defining the circular holes 44. This mating of tabs 50 and the holes 44 results in the clips 30 being restrained from moving in three directions, i.e. upwardly and to left or right as viewed in FIG. 3. Movement downwardly in the position of FIG. 2 is, of course, limited by abutment of the concave portion 32 with the upper wall 34.

The half-cases 14 and 16 are also formed with vertical openings 54 at the upper opposite corner portions thereof, the vertical openings 54 and the horizontal holes 44 at each corner portion being alligned, as shown.

The central portion 32 of each clip 30 is deformed downwardly to form a well 60 and a depending flange 61 defining an opening 62, the opening 62 being centrally aligned with the adjacent opening 54 and received therein, as shown in FIGS. 2 and 4.

Thus, to assemble together the half-cases 14 and 16, it is only necessary to position the clips 30 above the case 12, as shown in FIG. 1 for the clip on the right, and to press it down upon the half-cases 14 and 16. The tabs 50 will engage the upper corners 51 and 53 of the half-cases 14 and 16 and the side surfaces 40, but will flex outwardly as the pressure is continued until the tabs 50 snap into the holes 44.

When it is desired to mount the circuit breaker to a panel 66, FIGS. 3 and 4, a suitable threaded screw 68 is inserted through a suitable hole in the panel 66 and into the well 60 and is threaded into the opening 62. As the screw 68 threads into the opening 62, the shoulders 31 are drawn up tight against the panel 66 and the bowed central portion 32 is raised toward the panel 66, the continued threading of the screw 68 causing the central portion 32 to flex and to generally straighten to the position shown in FIG. 4, while simultaneously pulling up the approximately circular locking tabs 50 against the corresponding parts of the circular walls defining the holes 44, the threaded screw extending into the hole 54 and being limited in its downward movement by its enlarged head. Further, as the central portion 32 is pulled toward its horizontal position (FIG. 4) the arms 36 tend to cantilever inwardly toward each other, increasing the spring bias exerted by them against the side surfaces 40 of half-cases 14 and 16.

Referring to FIG. 6, a modified snap on mounting clip **30*a* is shown adapted for insertion by being pushed over the half-cases 14*a* and 16*a* by a generally horizontal motion rather than a vertical motion. As shown in FIG. 6, the locking tabs 50*a* are connected to the arms 36*a* on the left and bent inwardly about a generally vertical axis, so that the tabs 50*a*** have a generally horizontally extending extent.

Thus the clip **30*a* may easily slide laterally (horizontally) parallel to the dotted line indicated in FIG. 6 initially engaging the right hand corners 14*b* and 16*c* of the half-cases 14*a* and 16*a* and the side surface 40*a* until the tabs 50*a* snap into the holes 44*a* (only one hole 44*a* being shown in FIG. 6**).

To facilitate this lateral (horizontal) motion, the well **60*a* is not as deep as in the previous embodiment or the arms 36*a* are made slightly longer so as to raise the flange 61*a* and the thread receiving opening 62*a* above the surface 34*a*, otherwise the flange 61*a* would impringe on the corners 14*b* and 16*c* as it is moved horizontally into position over the hole 54*a*. Alternatively, the parts 14*c* and 16*c* of the half-case 14*a* and 16*a* between the openings 54*a* and the adjacent edges 14*b* and 16*b* of the half-cases may be recessed to permit the lateral insertion of the clip 30*a***, but these recesses are not illustrated.

From the foregoing it is seen that the snap on mounting clip 30 shown in FIGS. 1 to 5, inclusive, is attached to the half-cases 14 and 16 by a vertical sliding movement from a position above the top wall 34, FIG. 1, the clip 30 being moved down vertically unitl the tabs 50 spring into the holes 44. During such sliding movement and when the clip 30 is in the positions shown in FIGS. 2, 3, and 4, the tabs 50 extend generally parallel to the longitudinal axis of the screw 68.

Also, it is seen that the snap on mounting clip **30*a* shown in FIG. 6 is attached to the half-cases 14*a* and 16*a* by a horizontal sliding movement from a position to the right of the end wall 37*a*, the clip 30*a* being moved laterally until the tabs 50*a* engage the side walls 40 and then spring into the holes 44*a*. During such sliding movement and when the clip 30*a* is in its final position, the tabs 50*a* extend generally perpendicular to the longitudinal axis of the stud (not shown in FIG. 6) for securing the clip 30*a* to a suitable panel (not shown in FIG. 6**).

Referring to FIG. 7, another embodiment of this invention is shown. FIG. 7 illustrates a two pole circuit breaker 70, the two poles 71 and 72 being secured together by two fasteners 74 and rivets 75. The fasteners 74 are made long enough to bridge the two poles 71 and 72 which form the circuit breaker 70.

Each fastener 74 is provided with an arm 76 at opposite ends of the fastener 74, as shown in FIGS. 7 and 9. The central portion 75 of this fastener 74 is concave, i.e., bowed downwardly, as best shown in FIG. 7.

Further, each fastener 74 is provided with two depressed wells 73 forming depending lips 77 defining holes 78 into which are threaded suitable screws (not shown) for securing the circuit breaker 70 to a panel (not shown). In the central portion 75 of each fastener 74, between the two wells 76 a further arm 79 may be pressed out of the fastener 74, as best shown in FIG. 7. The arm 79 has a raised portion 77 which is above the central portion 75, as best shown in FIG. 9, so that the raised portion 77 together with the raised shoulder portions 81 and 83 provide a spring bias against the panel (not shown) when the fastener 74 is drawn against the panel by the threaded screws (not shown) which are received in the openings 78.

The end arms 76 and the intermediate arm 79 are each provided with tabs 69 to be received in suitable holes in the poles 71 and 72, as described in connection with FIGS. 1 to 5. The intermediate arm 79 and the left hand arm 76 together grasp the left hand pole 71 on opposite sides thereof to provide a more secure grip on the pole 71 in comparison to a fastener which would have only two end arms for grasping the two poles 71 and 72. In other respects the fastener 74 is constructed similar to the fastener 30 shown in FIGS. 1 to 5.

Referring to FIG. 8, a three pole circuit breaker 80 comprising poles 81, 82 and 83 is illustrated and shows how the single pole fastener 30 shown in FIGS. 1 to 5 and the two pole fastener of FIGS. 7 and 9 may be used to secure together and mount to a panel (not shown) the three pole circuit breaker 80. Also, rivets 84 may extend through the three pole circuit breaker to further secure them together.

On one side the single pole fastener 30 is attached to the pole 81 and the two pole fastener 74 is attached to the poles 82 and 83. On the other side, as shown in FIG. 8, the single pole fastener is secured to the pole 83 and the two pole fastener 74 is secured to the poles 81 and 82. Thus, the three pole circuit breaker 80 may be mounted by the single and double pole fasteners 30 and 74 to a panel (not shown).

In FIG. 10 a still further embodiment of the invention is illustrated. FIG. 10 illustrates a three pole circuit breaker 90 carrying poles 91, 92 and 93 secured together by three pole fasteners 94 and rivets 95. The three pole fasteners 94 of FIG. 10 are similar to the two pole fasteners 74, shown in FIGS. 7 and 9, except that they are longer to bridge three instead of two poles and are provided with three wells 96 for receiving screws (not shown) to mount the circuit breaker 90 to a panel (not shown). Each three pole fastener 94 may also be provided with an intermediate arm 98, as shown in FIG. 10, so that with one of the end arms 99 one of the end poles is grasped therebetween. Preferably, the fasteners 94 are placed on the three poles so that the fasteners will grasp opposite end poles, as shown.

A further embodiment is shown in partial FIG. 11 similar to that of FIG. 10. The fastener 100 in FIG. 11 bridges the three poles 102, 104 and 106 of the circuit breaker 107 and is provided with two end arms 108 and 109. Between the end arms 108 and 109 are provided two intermediate arms 110 and 112. The end arm 108 together with the intermediate arm 110 grasps the pole 102. The intermediate arm 112 grasps one side of the pole 104. If desired, the arm 112 could be bent in the opposite direction in which event it and the arm 109 would grasp the pole 106. The fastener 100 is provided with three suitable holes 120 to receive screws (not shown) to mount the circuit breaker to a panel (not shown). Each pole is provided with openings (not shown) as described in connection with the embodiment of FIGS. 1 to 5 for receiving the tabs 122 formed in each of the arms 108, 109, 110 and 112.

While the screw 68, in FIG. 4, has been shown and described as having a threaded portion mating with the hole 62 in the clip 30, it will be seen that the shank of the screw could be unthreaded and received in the hole 62 as a friction fit or the flange 61 could have tabs (not shown) frictionally engaging the shank.

What I claim is:

1. In a multi-pole circuit breaker comprising at least three poles the combination wherein each pole includes a molded case each comprising two half-cases abutting each other, a spring fastener embracing said cases, said half-cases having recesses, said fastener comprising a central portion and flexible arms on either end thereof embracing the end cases and biasing said end cases toward each other, each arm having a tab deformed toward the embraced case, each tab extending into one of said recesses, each recess being defined by a wall which surrounds said tab so as to limit movement of said tab in three directions, and said central portion including two further arms having tabs intermediate the end arms to jointly therewith embrace the end cases.

2. In a circuit breaker the combination comprising a molded case comprising two half-cases abutting each other, a spring fastener embracing said half-cases, said half-cases having recesses, said fastener comprising a central portion and flexible arms on either side thereof embracing said half-cases and biasing said half-cases toward each other, each arm having a tab deformed toward the embraced half-case, each tab extending into one of said recesses, each recess being defined by a wall which surrounds said tab so as to limit movement of said tab in three directions, said arms including end portions flared outwardly of said case, said arms being bowed to permit said arms to spring freely as they are pushed over said half-cases, said case including a top wall, and said central portion is bowed downwardly so as to be concave relative to said top wall of said case.

3. The combination of claim 2 wherein said top wall includes an opening, said central portion includes a thread receiving opening, and said openings are aligned to receive the shank of a threaded screw for mounting said circuit breaker to a panel.

4. In a circuit breaker the combination comprising a molded case comprising two half-cases abutting each other, a spring fastener embracing said half-cases, said half-cases having top walls and end walls, each half-case having two recesses disposed at the upper corners defined by each top wall and each adjacent end wall, said fastener comprising a central portion overlying said top walls of said half-cases and arms on either side thereof embracing said half-cases, each arm having a tab deformed toward the embraced half-case, each tab extending into one of said recesses, each recess being defined by a wall which surrounds said tab so as to limit movement of said tab in three directions, a panel to which said circuit breaker is mounted, said panel having a hole, said spring fastener having a hole, and a screw extending through said hole in the panel and threaded into said hole in said spring fastener, said screw having a head limiting downward movement of said screw, whereby said spring fastener is raised toward said panel as said screw is threaded into said spring fastener to bring said tabs into engagement with said walls defining said recesses, said central portion being bowed downwardly so as to be concave relative to said top walls, and each arm is spring biased against the adjacent half-case, whereby as said central portion is pulled toward said panel by said screw said arms cantilever inwardly toward each other, increasing the spring bias exerted against the half-cases.

5. The combination of claim 4 wherein said tabs extend generally parallel to the longitudinal axis of said stud, and said fastener is placed over said case by sliding it down over said case from the top wall thereof.

6. The combination of claim 4 wherein said tabs extend generally perpendicular to the longitudinal axis of said screw, and said fastener is placed over said case by sliding it laterally over the case from an end wall thereof.

7. The combination of claim 4 and further including a panel to which said circuit breaker is mounted, said panel having a hole, a frictional member extending through said hole in the panel and frictionally engaging said spring fastener, and said frictional member having a head abutting said panel to limit movement of said frictional member as it is inserted into said panel.

8. In a multi-pole circuit breaker the combination comprising a plurality of molded cases each comprising two half-cases abutting each other, a spring fastener embracing said cases, said half-cases having recesses, said fastener comprising a central portion and flexible arms on either end thereof embracing the end cases and biasing said end cases toward each other, each arm having a tab deformed toward the embraced case, each tab extending into one of said recesses, each recess being defined by a wall which surrounds said tab so as to limit movement of said tab in three directions, and said central portion including a further arm having a tab intermediate the end arms to jointly therewith embrace one of the end cases.

9. The combination of claim 8 wherein said tabs include end portions flared outwardly of the embraced case and said tabs are bowed to permit said tabs to spring freely as they engage the cases.

10. The combination of claim 8 wherein each case includes a top wall, and said central portion is bowed downwardly so as to be concave relative to the top walls of the cases.

11. The combination of claim 10 wherein each top wall includes an opening, said central portion includes thread receiving openings, and said openings of said central portion are aligned with the openings in the top walls to receive the shanks of threaded fasteners for mounting said multi-pole circuit breaker to a panel.

12. The combination of claim 8 and further including a panel to which said multi-pole circuit breaker is mounted, said panel having mounting holes, said spring fastener having mounting holes, screws extending through said holes in the panel and threaded into said holes in said spring fastener, said screws having heads limiting downward movement of said screws, whereby said spring fastener is raised toward said panel as said screws are threaded into said spring fastener to bring said tabs into engagement with said walls defining said recesses.

13. The combination of claim 12 wherein said central portion is bowed downwardly so as to be concave relative to said top walls, each arm is spring biased against the adjacent half-case, whereby as said central portion is pulled toward said panel by said screws said arms cantilever inwardly toward each other, increasing the spring bias exerted against the half-cases.

14. In a three pole circuit breaker the combination comprising molded cases each comprising two half-cases abutting each other, a spring fastener embracing said cases, said half-cases having recesses, said fastener comprising a central portion and flexible arms on either end thereof embracing the end cases and biasing said end cases toward each other, each arm having a tab deformed toward the embraced case, each tab extending into one of said recesses, and each recess being defined by a wall which surrounds said tab so as to limit movement of said tab in three directions, said three poles being secured together by four spring fasteners, two fasteners being common to two poles and placed adjacent opposite corner portions, but alternated so that one common fastener embraces poles 1 and 2 on one side and another common fastener embraces poles 2 and 3 on the other side, each pole on each side which is not embraced by the common fasteners being embraced by a separate fastener.

* * * * *